US006290538B1

(12) United States Patent
Pocrass

(10) Patent No.: US 6,290,538 B1
(45) Date of Patent: Sep. 18, 2001

(54) RJ TYPE COAXIAL CABLE CONNECTOR WITH VISUAL INDICATOR

(76) Inventor: Alan L. Pocrass, 41 Golden Glen Dr., Simi Valley, CA (US) 93065

( * ) Notice: Subject to any disclaimer, the term of this patent is extended or adjusted under 35 U.S.C. 154(b) by 0 days.

(21) Appl. No.: 09/524,934

(22) Filed: Mar. 14, 2000

(51) Int. Cl.[7] ..... H01R 9/05
(52) U.S. Cl. ..... 439/578; 439/607; 439/676
(58) Field of Search ..... 439/607, 610, 439/675, 676, 344, 394, 23, 20, 63, 578–585

(56) References Cited

U.S. PATENT DOCUMENTS

| | | | | |
|---|---|---|---|---|
| 3,523,269 | * | 8/1970 | Witek, Jr. et al. | 439/358 |
| 4,379,606 | | 4/1983 | Clark et al. | 439/76.1 |
| 4,457,570 | | 7/1984 | Bogese, II | 439/59 |
| 4,648,682 | * | 3/1987 | Tubbs | 439/502 X |
| 4,978,317 | | 12/1990 | Pocrass | 439/490 |
| 5,605,473 | * | 2/1997 | Kishon | 439/502 |
| 6,042,422 | * | 3/2000 | Youtsey | 439/585 |

* cited by examiner

*Primary Examiner*—Brian Sircus
*Assistant Examiner*—Son V. Nguyen
(74) *Attorney, Agent, or Firm*—Webb Ziesenheim Logsdon Orkin & Hanson, P.C.

(57) ABSTRACT

A coaxial cable connector includes a plug body having a first conductor extending therethrough which is exposed adjacent one end thereof and a first shield surrounding the first conductor and electrically isolated therefrom. The plug is configured to mate with a coaxial cable such that a core and shield of the coaxial cable are electrically connected to the respective first conductor and the first shield of the plug body. The connector includes a housing body having a receiving aperture formed therein for receiving the plug. A second conductor is received in the housing body for electrically contacting the first conductor when the plug is received in the receiving aperture. A second shield surrounds the receiving aperture and the second conductor and is electrically isolated from the second conductor. The first shield and the second shield are electrically connected when the plug is received in the receiving aperture. The housing body can include a lamp, a lamp circuit and/or a filter circuit therein. Moreover, an end of the plug body configured to mate with the coaxial cable can be rotatable with respect to the end of the plug body configured to be received in the receiving aperture of the housing body.

30 Claims, 8 Drawing Sheets

FIG. 1
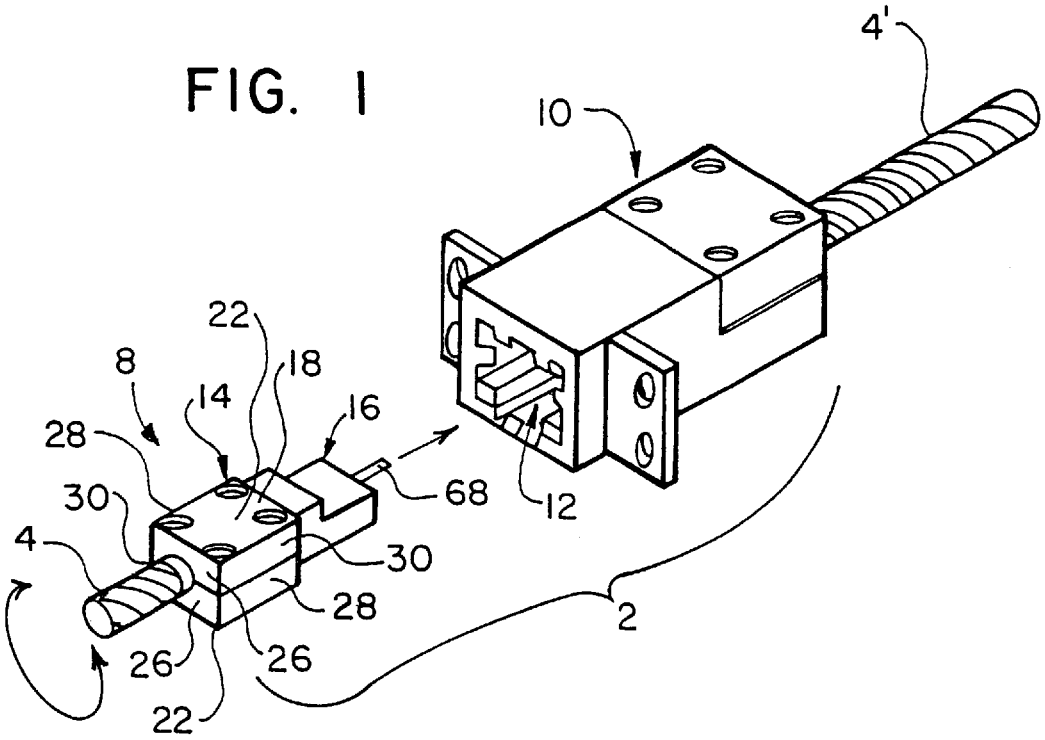
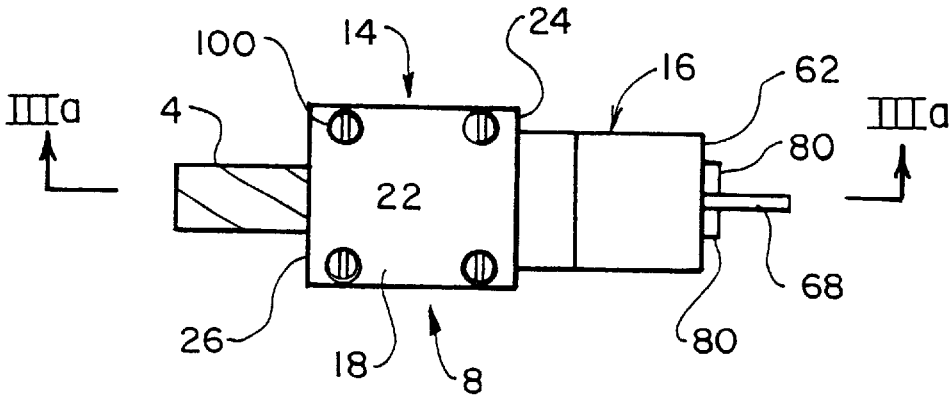
FIG. 2

8
14
16
18
22
24
26
34
36
38
40
42
44
46
48
56
58
60
62
64
68
70
72
74
76
78
80
82
84
86
90
92
94
96
4
100

RJ TYPE COAXIAL CABLE CONNECTOR WITH VISUAL INDICATOR

BACKGROUND OF THE INVENTION

1. Field of the Invention

The present invention relates to electrical connectors and, more specifically, to RJ type connectors for connection of broadband coaxial cables.

2. Background Art

Broadband coaxial cables and coaxial cable connectors are commonly used for connecting an RF signal source to an RF signal receiver. Some common RF signal sources/receivers include, television and audio receivers, amplifiers, decoders, satellite receivers, VCRs and DVD players.

Prior art coaxial connectors include a female-type screw-on type connector or a female-type plug-on type connector which can be connected to a male-type connector. More specifically, the screw-on type connector includes a female receptacle having an internally threaded bore configured to threadedly mate with external threads of a male coaxial connector connected to, for example, an electronic product or the terminal end of a coaxial cable. A problem with the screw-on type coaxial connector is that the relative inflexible coaxial cable makes the screw-on type connector difficult to align and threadedly mate. The plug-on type coaxial connector includes a female receptacle having an inside diameter configured to frictionally interact with the external threads of a male coaxial connector. While the plug-on type coaxial connector is much easier to attach than the screw-on type coaxial connector, the plug-on type coaxial connector can be separated from the male coaxial connector simply by pulling the coaxial cable or the female receptacle from the male coaxial connector.

It is, therefore, an object of the present invention to overcome the above problems and others by providing a coaxial cable connector which can be easily, removably connected between a pair of coaxial cables or between a coaxial cable and a printed circuit board (PCB) while providing electromagnetic shielding of a signal conveyed on the core of the coaxial cable(s). Still other objects of the present invention will become apparent to those of ordinary skill in the art upon reading and understanding the following detailed description.

SUMMARY OF THE INVENTION

Accordingly, I have invented a coaxial cable connector including a plug body having a base and a neck at opposite ends thereof. A first conductive cylinder is received in the base and is configured to receive a conductive core of a coaxial cable therein. A conductive wire is in electrical contact with the first cylinder. The wire extends through the plug body from the first cylinder through the neck. A securing means secures the coaxial cable and the plug body together when the core is received in the first cylinder. A first shield surrounds at least the first cylinder for electromagnetically shielding the first cylinder. The first shield is electrically insulated from the first cylinder and the wire, preferably, by the plug body which is an electrical insulator.

The first shield can also surround the wire for electromagnetically shielding the wire. The first shield can include a conductive coating or sheet that is (i) disposed on the periphery of the base around the first cylinder, (ii) disposed on a periphery of the neck around the wire and (iii) disposed through the plug body between the neck and the first cylinder.

The securing means can include a sleeve assembly having an externally threaded, male coaxial connector on a first end thereof and a sleeve having a mouth which opens toward a second end thereof. The male coaxial connector has a conductive core that extends therethrough and includes a receiving cylinder adjacent the first end of the sleeve assembly and a wire projection that extends into a cavity defined by the sleeve. The external threads of the male coaxial connector and the sleeve are in electrical contact and are electrically isolated from the core of the male coaxial connector. The sleeve is configured to receive the base of the plug body when the wire projection of the male coaxial connector is received in the first cylinder. The sleeve is in electrical contact with the first shield when the base of the plug body is received in the sleeve.

The securing means can also include a plurality of enclosure sections configured to mate and form an enclosure that is configured to receive the base of the plug body therein with the neck extending therefrom. When the core of the coaxial cable is received in the first cylinder, the enclosure sections are mated and the enclosure sections clamp the coaxial cable therebetween.

The first shield can include a first conductive sheet supported by the plug body surrounding the first cylinder and the wire. A second conductive sheet can be supported by each enclosure section. The second conductive sheet of each enclosure section can electrically contact a conductive shield of the coaxial cable when the core of the coaxial cable is received in the first cylinder and the enclosure sections are mated. An electrically conductive spring is biased in electrical contact between the second conductive sheet of each enclosure section and the first conductive sheet.

Preferably, when the coaxial cable is received in the first cylinder, the enclosure and the plug body are rotatable with respect to each other around an axis coaxial with the core of the coaxial cable.

The first shield can electrically contact a conductive shield of the coaxial cable when the securing means secures the coaxial cable and the plug body together.

The connector can also include a housing body including a receiving aperture formed therein for receiving the neck of the plug body. A conductor is received in the housing body and is configured to electrically contact the wire when the neck of the plug body is received in the receiving aperture. A second shield surrounds the receiving aperture and the conductor for electromagnetically shielding the receiving aperture and the conductor. The second shield is electrically insulated from the conductor.

The conductor can extend from the receiving aperture through the housing body and can have an exposed end which extends outward from the housing body. The second shield can also include a shield wire having an exposed end which extends outward from the housing body.

The wire has an exposed end which extends outward from the neck of the plug body. The conductor received in the housing body can include a second conductive cylinder configured to receive the exposed end of the wire when the neck is received in the receiving aperture.

The second cylinder can extend through the housing body between the receiving aperture and an exterior of the housing body for receiving the core of another coaxial cable therein from the exterior of the housing body. The housing body can include a securing means for securing the other coaxial cable thereto when the core of the other coaxial cable is received in the second cylinder.

The first shield electrically contacts the second shield when the neck of the plug body is received in the receiving aperture of the housing body. The second shield electrically contacts a conductive shield of the other coaxial cable when the core thereof is received in the second cylinder.

A lamp, such as an LED device, can be disposed in the housing body of the connector and a lamp circuit can be electrically connected to the lamp, the conductor and the second shield. The lamp circuit connects the lamp to a source of electrical power in response to detecting between the conductor and the second shield a voltage greater than a predetermined trigger voltage. Hence, illumination of the LED device provides visual indication of a condition in a given circuit.

A filter circuit can be disposed in the housing body of the connector. The filter circuit can be electrically connected between the conductor and the second shield for filtering electrical signals propagating on the conductor. The filter circuit can be disposed in the same housing as the lamp and the lamp circuit.

I have also invented a connector for a coaxial cable. The connector includes a plug body having a first conductor extending therethrough which exposed adjacent one end thereof and a first shield surrounding the first conductor and electrically isolated therefrom for electromagnetically shielding the first conductor. The plug is configured to mate with a coaxial cable such that a core and a shield of the coaxial cable are electrically connected to the respective first conductor and first shield of the plug body. The connector also includes a housing body including a receiving aperture formed therein for receiving the plug. A second conductor is received in the housing body for electrically contacting the first conductor when the plug is received in the receiving aperture. A second shield surrounds the receiving aperture and the second conductor. The second shield is electrically isolated from the second conductor for electromagnetically shielding the receiving aperture and the second conductor. The first shield and the second shield are electrically connected when the plug is received in the receiving aperture.

Preferably, the plug body is an RJ type male plug having the first conductor exposed on a periphery thereof that is configured to be received in the receiving aperture and the housing is an RJ type female housing having the second conductor positioned to contact the first conductor when the plug body is received in the receiving aperture.

The first conductor can include a plurality of contacts exposed on the periphery of the plug body and the second conductor can include a plurality of contacts positioned to contact the plurality of contacts exposed on the periphery of the plug body when the plug body is received in the receiving aperture.

The first conductor can have an exposed end which extends outward from the plug body and the second conductor can include a cylinder configured to receive the exposed end of the conductor when the plug body is received in the receiving aperture.

The connector includes an enclosure enclosing one end of the plug body adjacent an end of the plug body opposite the exposed end of the first conductor. The enclosure secures the coaxial cable and the plug body together and the coaxial cable and the enclosure are rotatable with respect to the plug body around an axis of the core of the coaxial cable.

A lamp can be disposed in the housing body and a lamp circuit can be electrically connected to the lamp, the second conductor and the second shield. The lamp circuit can connect the lamp to a source of electrical power in response to detecting between the second conductor and the second shield a voltage greater than a predetermined voltage.

The second conductor and the second shield can each include an exposed wire that extends away from the housing body for electrical connection to another fixture.

A filter circuit can be disposed in the housing body. The filter circuit can be connected between the second conductor and the second shield for filtering electrical signals propagating on the second conductor.

BRIEF DESCRIPTION OF THE DRAWINGS

FIG. 1 is a perspective view of a wall mount RJ type coaxial cable connector having a male plug and a female housing in the form of a common RJ type connector to provide a snap fit connection for coaxial cables in accordance with one embodiment of the present invention;

FIG. 2 is a top view of the male plug of the coaxial cable connector shown in FIG. 1;

DETAILED DESCRIPTION OF THE PREFERRED EMBODIMENTS

Figures 3A, 3B:
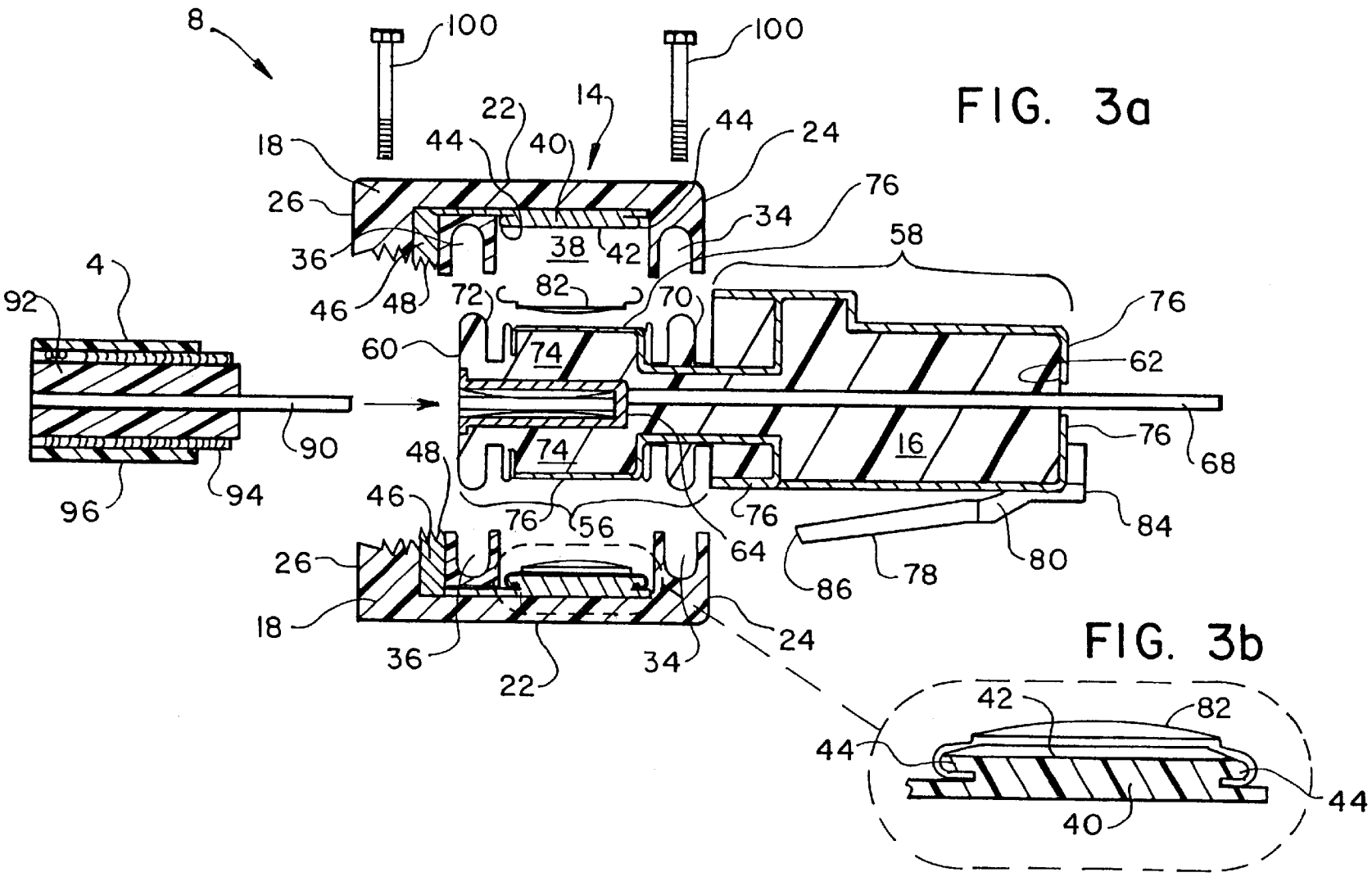
FIG. 3*a* is an exploded sectional view taken along lines IIIa—IIa in FIG. 2.
FIG. 3*b* is an enlarged view of the leaf spring contact attached to an enclosure section in FIG. 3*a;*

The present invention will be described with reference to FIGS. 1–11, where like reference numbers correspond to like elements. The following detailed description includes words such as, "horizontal", "vertical", "top" and "bottom". It is to be understood that these words are used in connection with the various views and embodiments of the present invention shown in the figures and are not to be construed as limiting the invention.

With reference to FIG. 1, an RJ type coaxial cable connector 2 can be utilized to easily, removably connect a coaxial cable 4 and a coaxial cable 4'. The coaxial cable connector 2 includes a male plug 8 and a female housing 10 having a receiving aperture 12 configured to receive plug 8 therein.

Plug 8 includes an enclosure 14 which is received around one end of an elongated and insulating plug body 16. The enclosure 14 preferably includes a pair of insulating enclosure sections 18 that can be mated together to form enclosure 14.

With reference to FIGS. 2–3*b*, and with continuing reference to FIG. 1, each enclosure section 18 includes a top 22, a first end 24, a second end 26, a first side 28 and a second side 30. Adjacent first end 24, each enclosure section 18 includes a first alignment slot or hole 34. Between first alignment slot 34 and second end 26, each enclosure section 18 includes a second alignment slot or hole 36. Between first alignment slot 34 and second alignment slot 36, each enclosure section 18 includes a trough 38 having a conductive coating or sheet 40 received in a base thereof. Each enclosure section 18 includes a conductive contact 46 between second alignment slot 36 and second end 26, preferably adjacent second alignment slot 36. Each contact 46 includes an outer edge 48 which faces opposite top 22 and an edge opposite outer edge 48 which is electrically connected to sheet 40. Each sheet 40 includes an outer surface 42 which faces opposite top 22 and a pair flared and rolled sides 44 which extend from sheet 40 toward first alignment slot 34 and second alignment slot 36.

Plug body 16 includes a base 56 and a neck 58 adjacent a respective first end 60 and second end 62 thereof. A conductive cylinder 64 is received in base 56. Conductive cylinder 64 extends from first end 60 toward second end 62 and preferably terminates before neck 58. A conductive wire 68 is connected in electrical contact with cylinder 64. Conductive wire 68 extends from cylinder 64 through neck 58 to second end 62. In the embodiment shown in FIG. 3*a*, wire 68 has an exposed end which extends outward from second end 62.

Base 56 includes a first alignment rib or pin 70 and a second alignment rib or pin 72 configured to mate with first alignment slot 34 and second alignment slot 36, respectively, of each enclosure section 18. Base 56 also includes a ring 74 positioned between and spaced from first alignment rib 70 and second alignment rib 72. Preferably, first and second alignment slots 34 and 36 of each enclosure section 18 have an arcuate form between first side 28 and second side 30. Moreover, the outer surfaces of first and second alignment ribs 70, 72 and ring 74 are preferably circular and coaxial with a longitudinal axis of cylinder 64. Preferably, when enclosure 14 is formed around base 56, the first and second alignment slots 34 and 36 of each enclosure section 18 coact to form circular alignment slots that receive first and second alignment ribs 70 and 72, respectively, so that enclosure 14 and plug body 16 are rotatable with respect to each other around the longitudinal axis of cylinder 64.

A coating or sheet 76 is disposed on plug body 16 so it surrounds, but is electrically isolated from, cylinder 64 and wire 68. In the embodiment shown in FIG. 3*a*, conductive sheet 76 is disposed on a periphery of base 56 and a periphery of neck 58, preferably ring 74, around cylinder 64 and wire 68, respectively. Between cylinder 64 and neck 58, sheet 76 is preferably disposed through plug body 16. Preferably, first and second alignment ribs 70 and 72 do not include sheet 76 thereon to promote rotation between enclosure 14 and plug body 16.

Housing body 2 includes a lever 78 having a first end 84 connected to plug body 16 adjacent second end 62 thereof. Lever 78 extends from second end 62 toward first end 60 and away from plug body 16 and terminates in a second end 86 spaced from plug body 16. A pair of wings 80 extend from opposite sides of lever 78 adjacent second end 62 of plug body 16. Preferably, lever 78 has a spring memory which enables second end 86 to return to a position in spaced relation with plug body 16 after being urged toward plug body 16.

To promote electrical contact between sheet 40 of each enclosure section 18 and sheet 76 disposed on plug body 16, a conductive leaf spring contact 82 is biased between sheet 40 of each enclosure section 18 and sheet 76 disposed on plug body 16, preferably the portion of sheet 76 surrounding ring 74, when the plurality of enclosure sections 18 are mated to form enclosure 14. To avoid movement between each leaf spring contact 82 and sheet 40, opposite sides of each leaf spring contact 82 are fitted around the flared and rolled sides 44 of sheet 40 as shown in FIG. 3*b*. When the plurality of enclosure sections 18 are mated to form enclosure 14, sheets 40, sheet 76 and leaf spring contacts 82 coact to form a shield around cylinder 64 and wire 68 for electromagnetically shielding cylinder 64 and wire 68.

Coaxial cable 4 includes a conductive core 90 surrounded by an insulating jacket 92. Insulating jacket 92 is surrounded by a conductive shield 94 which is surrounded by an insulating sheath 96. A portion of shield 94 is exposed between the end of jacket 92 and the end of sheath 96, and core 90 has an exposed end that extends outward from an end of jacket 92.

Prior to forming enclosure 14 around base 56, coaxial cable 4 is mated with plug 16. Specifically, the exposed end of core 90 is received in cylinder 64 so that the end of jacket 92 abuts or is closely adjacent first end 60 of plug body 16. Next, the enclosure sections 18 are mated together around base 56 and jacket 92, shield 94 and sheath 96 adjacent the end of coaxial cable 4. When enclosure sections 18 are mated together to form enclosure 14, edge 48 of contact 46 of each enclosure section 18 and an edge of each enclosure section 18 adjacent second end 26, facing in a direction opposite top 22, contacts and clamps the respective shield 94 and insulating sheath 96 of first coaxial cable 4 therebetween. Clamping coaxial cable 4 between enclosure sections 18 in this manner avoids withdrawal of the exposed end of core 90 from cylinder 64.

Figure 4:
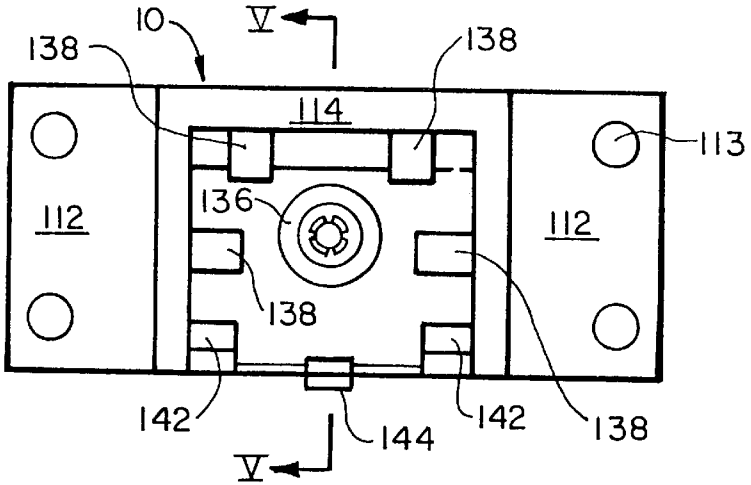
FIG. 4 is a view of the receiving aperture end of the female housing in FIG. 1.
Figure 5:
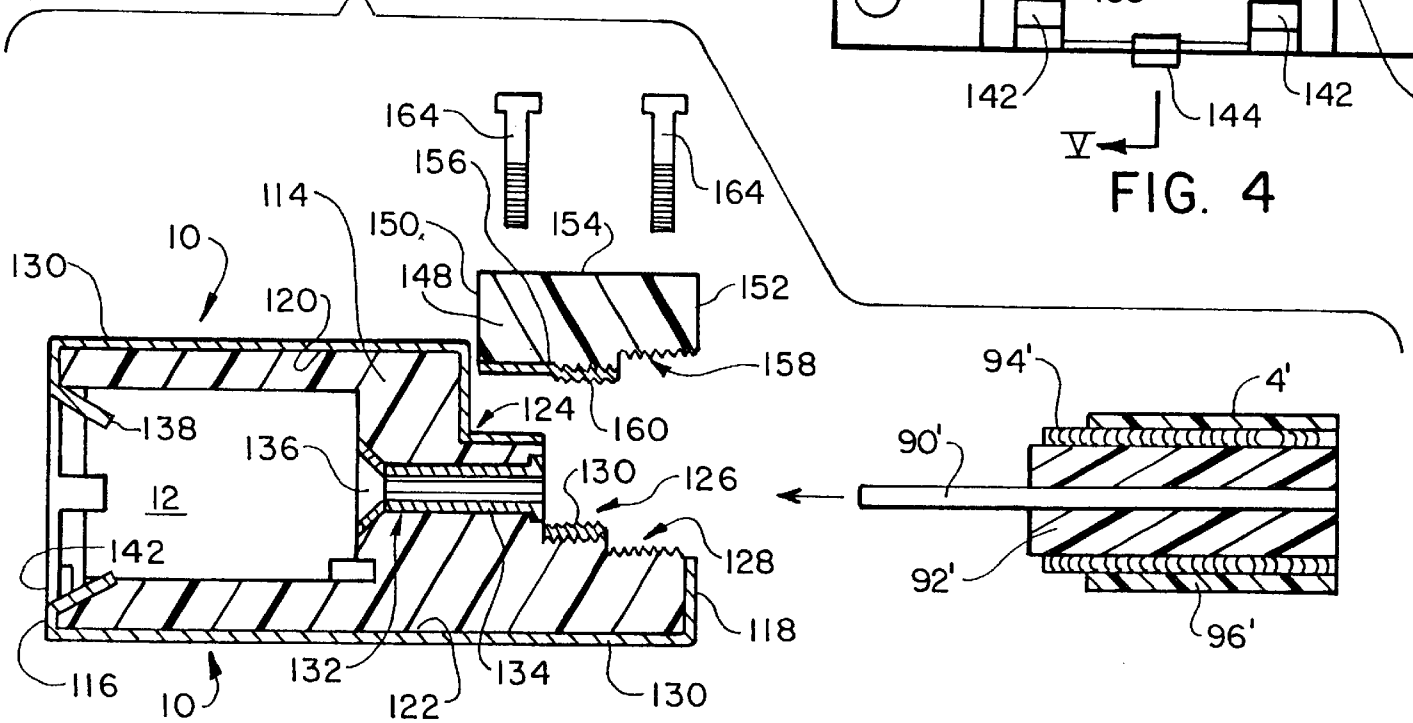
FIG. 5 is an exploded sectional view taken along lines V—V in FIG. 4.

With reference to FIGS. 4 and 5, and with continuing reference to FIGS. 1–3*b*, in one embodiment of the present invention, housing 10 includes a pair of flanges 112 which extend from opposite sides of an insulating housing body 114. Each flange 112 includes one or more holes 113, with each hole 113 configured to receive a fastener for mounting housing 10 to a wall. Housing body 114 also includes a first end 116, a second end 118, a top 120 and a bottom 122. Housing body 114 includes a plurality of stair steps 124, 126 and 128 which converges from top 120 toward bottom 122 adjacent second end 118. Housing body 114 includes a conductive coating or sheet 130 surrounding receiving aperture 12 which has a mouth which opens toward first end 116 for receiving neck 58 of plug body 16.

A conductor 132 is received in housing body 114 between receiving aperture 12 and the vertical surface of stair step 126. In the embodiment shown in FIGS. 4 and 5, conductor 132 includes a cylinder 134 having a truncated cone 136 which converges from receiving aperture 12 toward cylinder 134.

Sheet 130 surrounds housing body 114 and is electrically insulated thereby from cylinder 134 and cone 136. Preferably, sheet 130 includes tabs 138 which extend into receiving aperture 12 for electrically contacting sheet 76 when neck 58 is received in receiving aperture 12. A pair of lock wings 142 are positioned on opposite sides of the mouth of receiving aperture 12 adjacent bottom 122 to engage wings 80 of lever 78 in a manner known in the art, when neck 58 is received in receiving aperture 12. Second end 86 of lever 78 can be urged toward plug body 16, thereby lifting wings 80 above lock wings 142 and avoiding interference therebetween so that neck 58 can be removed from receiving aperture 12.

In the embodiment shown in FIG. 5, housing 10 includes a cap 148 having a first end 150, a second end 152, a top 154 and a bottom 156. Bottom 156 includes a stair step 158 which converges from bottom 156 toward top 154 adjacent second end 152. Preferably, bottom 156 of cap 148, other than on the horizontal and vertical surfaces of stair step 158, includes a conductive sheet or coating 160 thereon.

To secure coaxial cable 4' to housing 10, an exposed portion of core 90' is received in cylinder 134 with the end of jacket 92' abutting or closely adjacent the horizontal surface of stair step 126. When core 90' of coaxial cable 4' is received in cylinder 134 in this manner, the exposed portion of shield 94' between the end of jacket 92' and the end of sheath 96' electrically contacts the portion of sheet 130 on the horizontal surface of stair step 126, and sheath 96' contacts the horizontal surface of stair step 128.

Next, cap 148 is mated to housing body 114 with first end 150 abutting or closely adjacent to the horizontal surface of stair step 124 and with sheet 160 contacting and bridging shield 94' and the portion of sheet 130 on the horizontal surface of stair step 124. Next, cap 148 is secured to housing body 114 by screws 164 received in receiving apertures (not shown) of cap 148 and housing body 114 to secure coaxial cable 4' and housing 10 together. Securing cap 148 and housing body 114 together, clamps shield 94' between sheet 160 and sheet 130 on the horizontal surface of stair step 126 and clamps sheath 96' between the horizontal surface of stair step 158 and the horizontal surface of stair step 128. Clamping coaxial cable 4' between housing body 114 and cap 148 in this manner avoids withdrawal of the exposed end of core 90' from cylinder 134.

In use, when plug 8 and housing 10 are secured to coaxial cable 4 and coaxial cable 4', respectively, and when neck 58 is received in receiving aperture 12, an electrical connection is formed between cores 90, 90' and shields 94, 94' of coaxial cables 4 and 4' by the electrical contact formed by tabs 138 between sheets 76 and 130. Preferably, receiving aperture 12 is configured so that when neck 58 is received therein, the exposed end of wire 68 is guided by truncated cone 136 into cylinder 134.

Sheet 40 of each enclosure section 18 and sheet 76 surrounding plug body 16 coact to form an electromagnetic shield around cylinder 64 and the portion of wire 68 received in plug body 16. These sheets 40 and 76 coact with shield 94 of first coaxial cable 4 to electromagnetically shield signals propagating between core 90 of coaxial cable 4, cylinder 64 and the portion of wire 68 received in plug body 16. Similarly, sheet 130 and sheet 160 coact with shield 94' of coaxial cable 4' to electromagnetically shield signals propagating between core 90' and cylinder 134. When received in cylinder 134, the exposed end of wire 68 is electromagnetically shielded by sheet 130. As discussed above, when neck 58 is received in receiving aperture 12 and tabs 138 of sheet 130 contact sheet 76, a continuous electromagnetic shield is formed by plug 8 and housing 10 between shield 94 of coaxial cable 4 and shield 94' of coaxial cable 4'.

Figure 6:
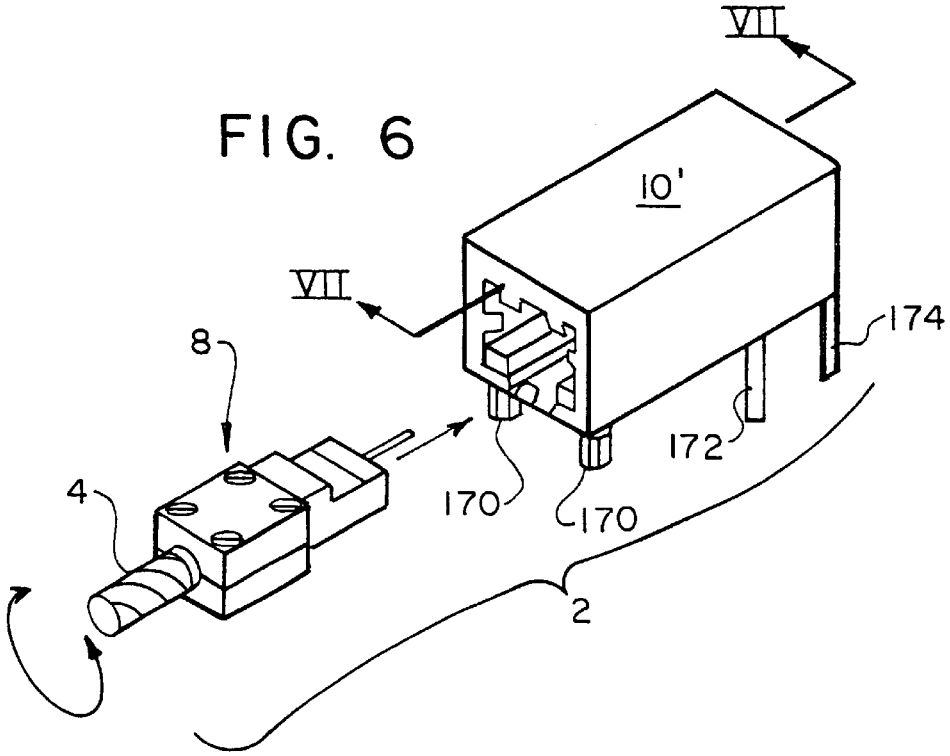
FIG. 6 is a perspective view of an RJ type PCB mount coaxial cable connector having a male plug and a female housing in the form of a common RJ type connector to provide a snap fit connection for a coaxial cable and a PCB in accordance with another embodiment of the present invention.
Figure 7:
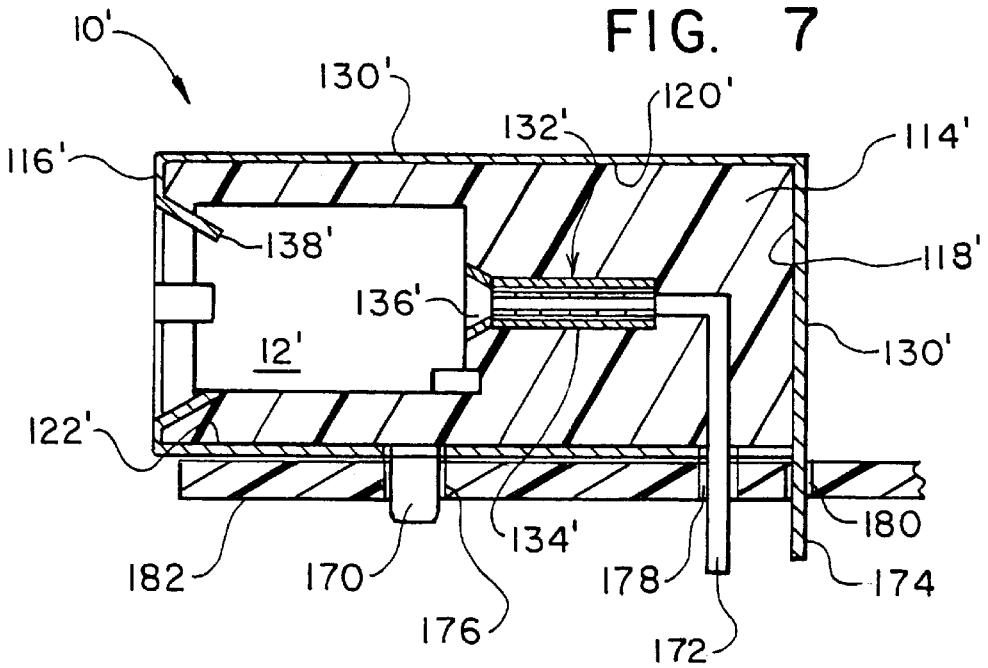
FIG. 7 is a sectional view taken along lines VII—VII in FIG. 6.

With reference to FIGS. 6 and 7, and with continuing reference to FIGS. 1–5, another embodiment of the RJ tpe coaxial cable connector 2 includes plug 8 described above and a housing 10'. Housing 10' has a one-piece housing body 114' having one or more mounting posts 170 extending from the bottom 122' thereof. A conductive pin 172 is electrically connected to conductor 132' and, more particularly, to cylinder 134' which comprises conductor 132'. Pin 172 extends through housing body 114' and outward from bottom 122'.

Sheet 130' surrounds housing body 114' and is electrically isolated thereby from cylinder 134' and pin 172. Sheet 130' has tabs 138' for contacting sheet 76 when neck 58 of plug body 16 is received in receiving aperture 12'. Sheet 130' also includes a conductive shield pin 174 which extends outward from bottom 122'. Mounting posts 170, pin 172 and shield pin 174 are configured to be received in through-holes 176, 178 and 180, respectively, of a conventional printed circuit board (PCB) 182. Preferably, through-holes 178 and 180 each have an internal plating that is electrically connected to a conductive trace (not shown) disposed on PCB 182 which is connected to one or more electronic components (not shown) mounted on PCB 182 in a manner known in the art. A solder (not shown) is preferably introduced between pin 172 received in plated through-hole 178 and between shield pin 174 received in plated through-hole 180 to promote electrical contact therebetween.

Figures 8, 9:
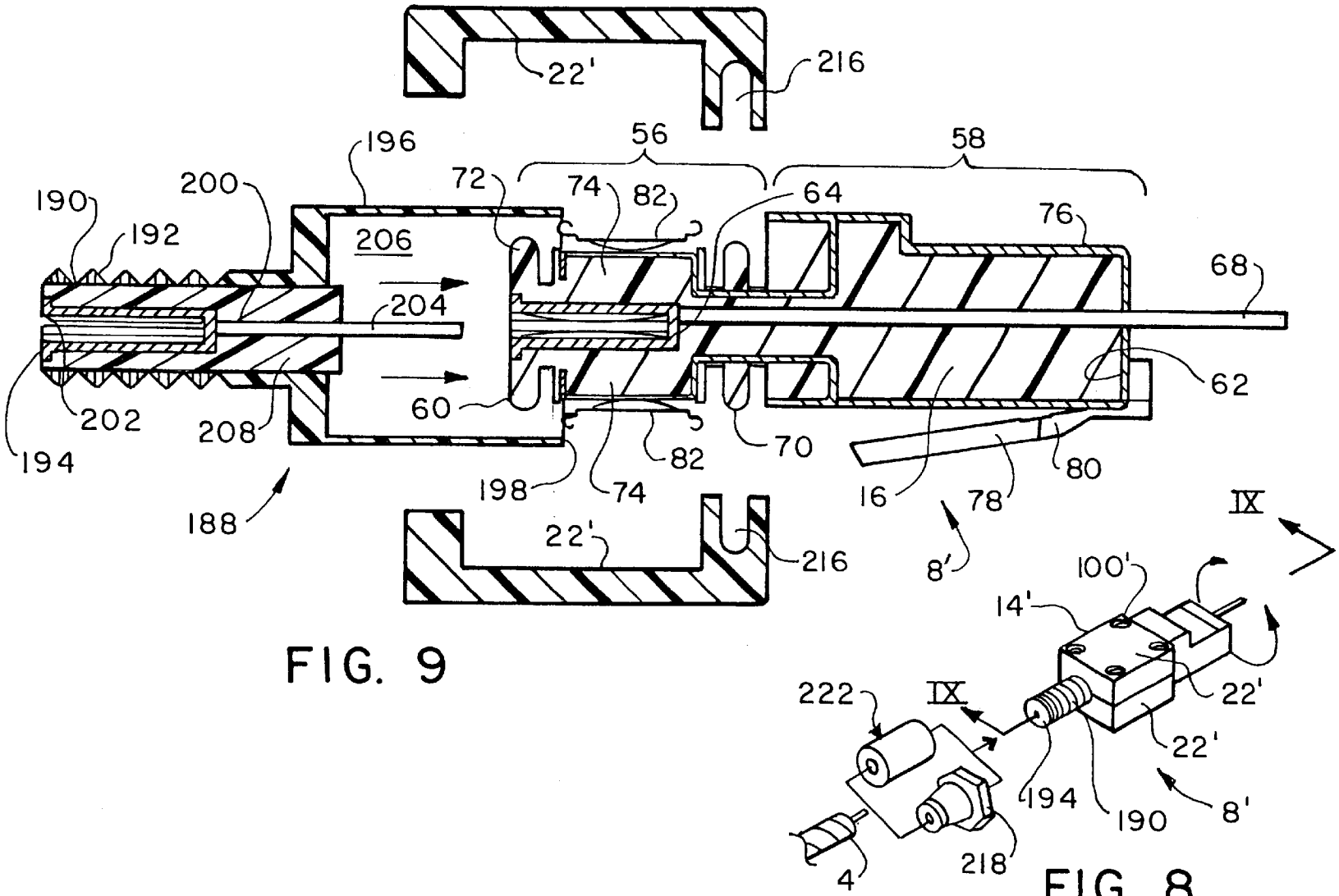
FIG. 8 is a perspective view of another embodiment of the male plug of the coaxial cable connector in accordance with the present invention.
FIG. 9 is an exploded sectional view taken along lines IX—IX in FIG. 8.

With reference to FIGS. 8 and 9, and with continuing reference to FIGS. 1–7, another embodiment of coaxial cable connector 2 includes housing 10 or 10' and plug 8' including plug body 16, cylinder 64, wire 68, first and second alignment ribs 70 and 72, ring 74, sheet 76, lever 78 and wings 80 described above and a sleeve assembly 188. Sleeve assembly 188 includes an externally threaded, male coaxial connector 190 at a first end 194 thereof and a conductive sleeve 196 having a mouth which opens toward a second end 198 thereof. Connector 190 has a conductive core 200 that includes a cylinder 202 adjacent first end 194 and a wire 204 which extends from cylinder 202 through connector 190 and which has an exposed end which extends into a cavity 206 defined by conductive sleeve 196. Connector 190 includes conductive external threads 192 which are electrically connected to sleeve 196. External threads 192 and sleeve 196 are electrically isolated from core 200 by an insulating jacket 208 therebetween.

Figure 10:
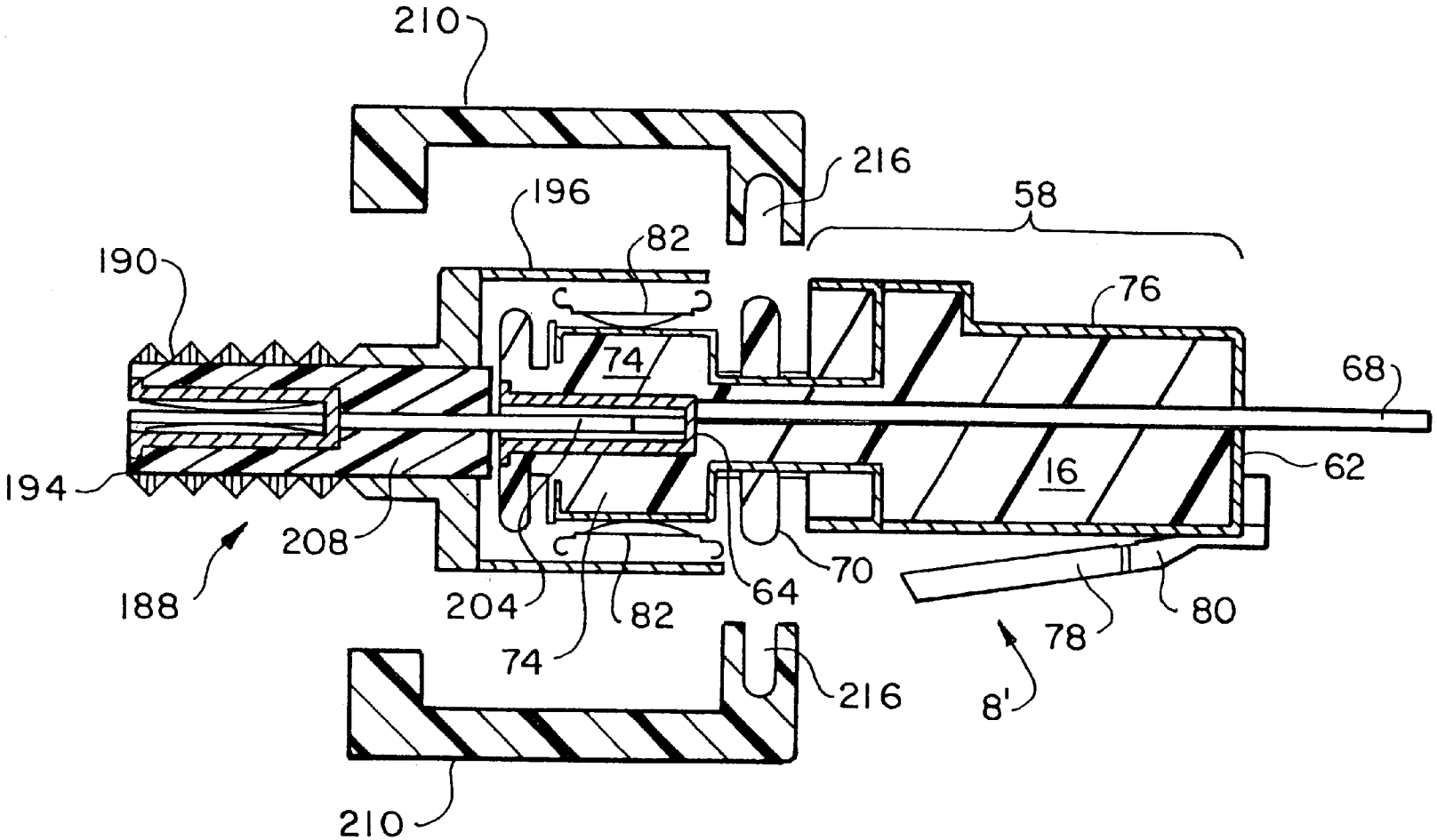
FIG. 10 is a partially assembled sectional view of the male plug shown in FIG. 9.

With reference to FIG. 10, and with ongoing reference to FIGS. 8 and 9, in use, base 56 is received in cavity 206 and the exposed end of wire 204 is received in cylinder 64 with first end 60 of plug body 16 abutting or closely adjacent an end of jacket 208 facing cavity 206. To promote contact between sleeve 196 and sheet 76, preferably with the portion of sheet 76 disposed on ring 74, one or more leaf spring contacts 82 are biased therebetween.

Next, a pair of enclosure sections 22' are mated around sleeve 196 and first alignment rib 70 of plug body 16 and are secured together by screws 100' to form an enclosure 14', shown best in FIG. 8. More specifically, each enclosure section 22' includes an arcuate alignment slot 216 configured to receive first alignment rib 70 when enclosure sections 221 are mated therearound. Preferably, when the pair of enclosure sections 221 are mated together, the alignment slots 216 thereof coact to form a circular alignment slot which receives first alignment rib 70 therein so that enclosure 14' and plug body 16 are rotatable with respect to each other around the longitudinal axis of cylinder 64.

Once plug 8 is assembled, external threads 192 of connector 190 can be mated with an internally threaded female coaxial connector 218 or a friction fit female coaxial connector 222 connected to the end of coaxial cable 4 in a manner known in the art.

In each of the foregoing embodiments of coaxial cable connector 2, the exposed end of wire 68 is received in cylinder 134 or 134', respectively. In the embodiment of coaxial cable connector 2 shown in FIG. 11, however, conductive wire 68 is replaced with one or more conductive wires or strips 228 that extend through plug body 16 and are exposed along the face of second end 62 and, preferably, a top surface 230 of plug body 16 adjacent second end 62 in the same manner as the conductors of a male plug of a conventional RJ type connector. Moreover, one or more conductive wires or strips 232 are disposed through receiving aperture 12 or 12' between a sidewall 236 thereof and a wire or strip form of conductor 132 or 132' in the same manner as the conductive strips of a female housing of a conventional RJ type connector. The exposed surfaces of each wire 228 and the portion of each strip 232 disposed through receiving aperture 12 or 12' are oriented to contact each other when neck 58 is received in receiving aperture 12 or 12'.

Figure 11:
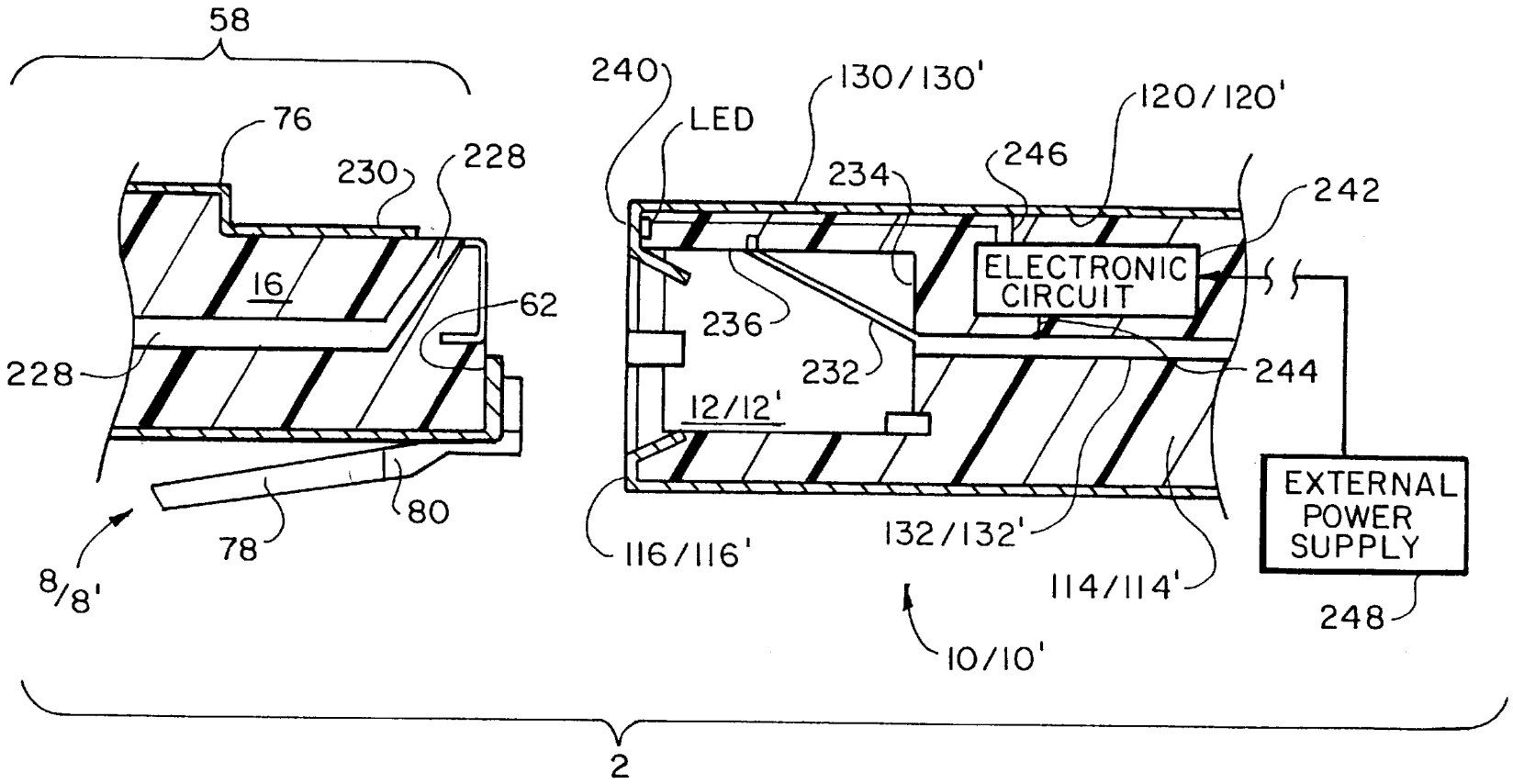
FIG. 11 is a partial sectional view of another embodiment of the mating ends of the coaxial cable connectors in accordance with the present invention.

In the embodiment of coaxial cable connector 2 shown in FIG. 11, the end of plug 8 or 8' opposite second end 62 can be of the form shown in FIGS. 3*a* and 3*b* or FIGS. 9 and 10, with the ends of the one or more conductive wires 228 opposite second end 62 connected to cylinder 64. Similarly, the end of housing 10 or 10' opposite the mouth of receiving aperture 12 or 12' can be of the form shown in FIGS. 4 and 5 or FIGS. 6 and 7 and the conductor 130 can include wire 172 and/or cylinder 134 or 134' as required by the application.

As shown in FIG. 11, housing 10 or 10' can include a lamp 240, preferably a light emitting diode (LED), disposed in housing body 114 or 114' for viewing adjacent the mouth of receiving aperture 12 or 12'. Lamp 240 is connected to an electronic circuit 242 also disposed in housing body 114 or 114'. Electronic circuit 242 is connected by conductors 244 and 246 to conductor 132 or 132' and sheet 130 or 130', respectively. Electronic circuit 242 is also connected to an external power supply 248 which can be mounted on PCB 182 or another suitable mounting fixture to which housing 10 or 10' is mounted. In response to detecting a voltage above a threshold level between conductor 132 or 132' and sheet 130 or 130', electronic circuit 242 causes lamp 240 to receive from external power supply 248 sufficient electrical power to cause lamp 240 to illuminate. Additional features of an RJ type connector having a visual indicator are disclosed in U.S. Pat. No. 4,978,317 to Pocrass which is expressly incorporated herein by reference.

Figure 12:
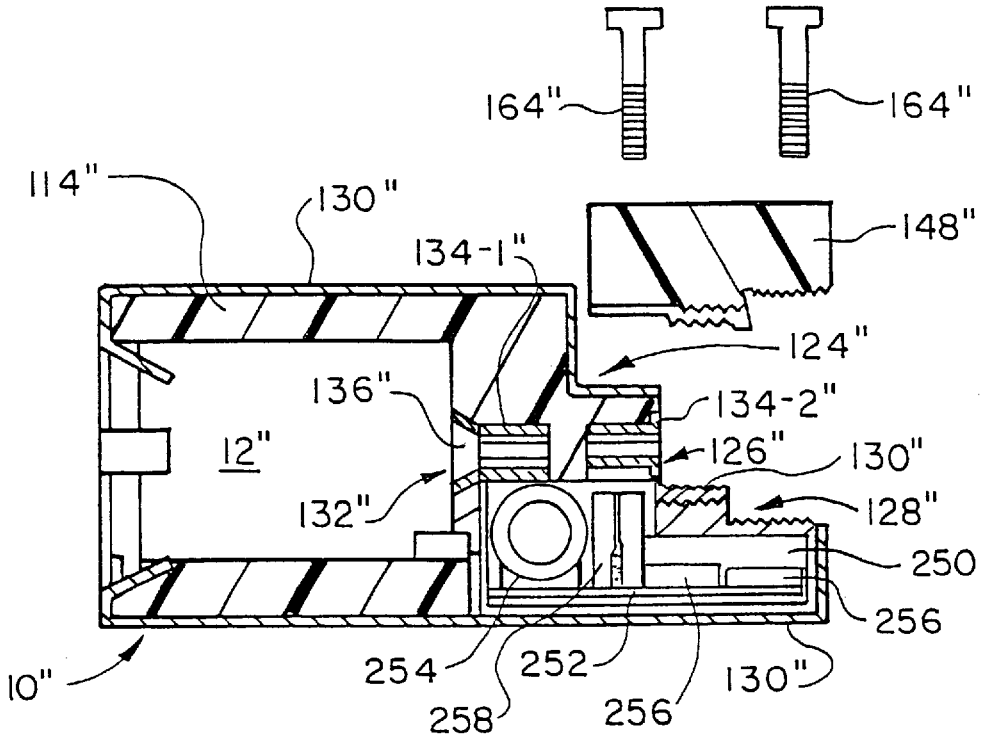
FIG. 12 is an exploded sectional view of a female housing in accordance with another embodiment of the invention including a filter circuit therein.

With reference to FIG. 12, and with reference back to FIGS. 1–5, another embodiment of the RJ type coaxial cable connector 2 includes plug 8 and a housing 10". Housing 10" has a similar configuration to housing 10 shown in FIG. 5, however, housing 10" includes conductor 132" which has a first cylinder 134-1" and a trunated cone 136" which converges from receiving aperture 12" toward cylinder 134-1". Conductor 132" also has a second cylinder 134-2" which extends from the vertical surface of stair step 126" toward first cylinder 134-1" and which terminates in opposition therewith. Preferably, first cylinder 134-1" and second cylinder 134-2" are positioned coaxially and have a portion of insulating housing body 114" disposed therebetween for insulating first cylinder 134-1" and second cylinder 134-2" from each other. Housing 10" includes a filter circuit 250 disposed in housing body 114". Filter circuit 250 is preferably configured to filter unwanted frequencies propagating between first cylinder 134-1" and second cylinder 134-2". Preferably, filter circuit 250 includes a printed circuit board (PCB) 252 having one or more inductors 254, one or more capacitors 256 and/or one or more resistors 258 mounted thereon in a manner known in the art. Inductors 254, capacitors 256 and/or resistors 258 are electrically connected in a manner known in the art between first cylinder 134-1", second cylinder 134-2" and sheet 130" to filter desired frequencies from propagating between first cylinder 134-1" and second cylinder 134-2".

Figure 13:
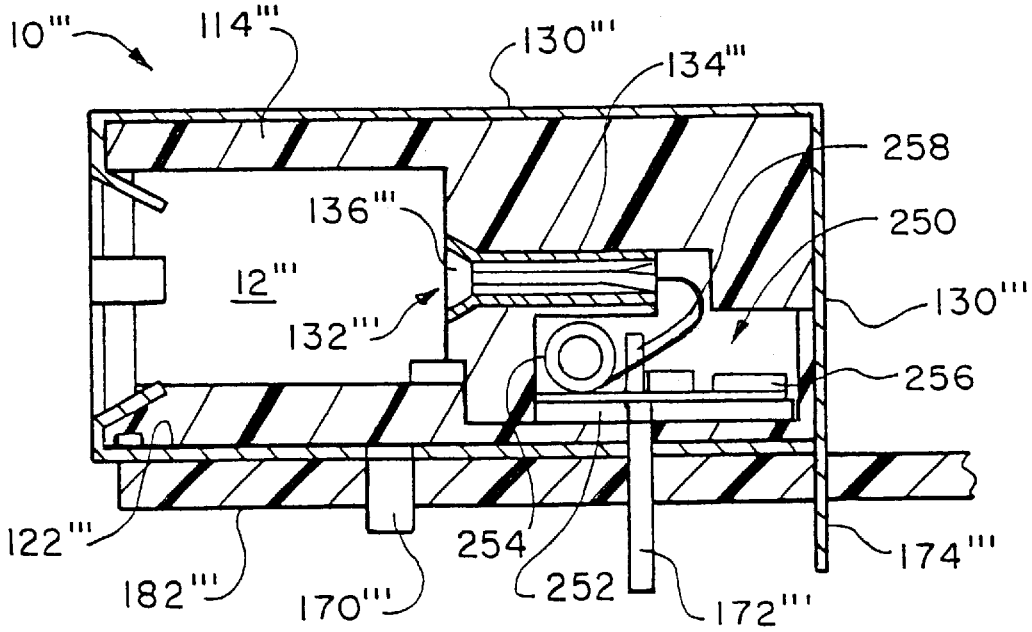
FIG. 13 is an exploded sectional view of a female housing in accordance with yet another embodiment of the invention including a filter circuit therein.

With reference to FIG. 13, and with reference back to FIGS. 1–3*b*, 6 and 7, another embodiment of the RJ type coaxial connector 2 includes plug 8 described above and a housing 10'". Housing 10'" has a one piece housing body 114'" having one or more posts 170'" extending from a bottom 122'" thereof. Housing 10'" has a conductor 132'", preferably a cylinder 134'" and a truncated cone 136'" which converges from receiving aperture 12'" toward cylinder 134'". A conductive pin 172'" extends from an interior of housing body 114'" outward from bottom 122'". Housing body 114'" includes filter circuit 250 received therein in the same manner as filter circuit 250 in FIG. 12. Filter circuit 250 in FIG. 13 is electrically connected between cylinder 134'", pin 172'" and sheet 130'" in the same manner as filter circuit 250 is connected between first cylinder 134-1", second cylinder 134-2" and sheet 130" in FIG. 12. In this respect, the one or more inductors 254, one or more capacitors 256 and/or one or more resistors 258 are connected in a manner known in the art to filter desired frequencies propagating between cylinder 134'" and pin 172'".

Housing 10" and 10'" are configured to receive the exposed end of wire 68 in first cylinder 134-1" and cylinder 134'", respectively. However, conductive wire 68 can be replaced with one or more conductive wires 228 disposed on the surface of plug 8 as shown in FIG. 11. Moreover, conductive wires or strips can be received in receiving aperture 12" or 12'" and connected to a conductive wire or strip form of conductor 132" or 132'" in the same manner as strips 232 in FIG. 11. Moreover, while FIGS. 12 and 13 show one filter circuit 250, each electrically isolated conductor 132" and 132'" disposed in housing 10" and 10'", respectively, can have a dedicated filter circuit 250 connected thereto.

As can be seen, the present invention provides a coaxial cable connector, preferably an RJ tppe coaxial cable connector, which can be easily, removably connected between a pair of coaxial cables or between a coaxial cable and a printed circuit board while providing electromagnetic shielding of the signal conveyed on the core of the coaxial cable(s).

The present invention has been described with reference to the preferred embodiments. Obvious modifications and alterations will occur to others upon reading and understanding the preceding detailed description. For example, housing 10, 10', 10" or 10'" can be formed as part of a cover plate that can be installed over an opening in a wall where coaxial cable access is desired. Moreover, lamp 240, electronic circuit 242 and filter circuit 250 can be disposed in a common housing 10, 10', 10" or 10'". It is intended that the invention be construed as including all such modifications and alterations insofar as they come within the scope of the appended claims or the equivalents thereof.

I claim:

1. A coaxial cable connector comprising:

a plug body including a base and a neck at opposite ends of the plug body;

a first, conductive cylinder received in the base and configured to receive a conductive core of a coaxial cable therein;

a conductive wire in electrical contact with the first cylinder, the wire extending through the plug body from the first cylinder through the neck;

securing means for securing the coaxial cable and the plug body together when the core is received in the first cylinder; and a first shield surrounding at least the first cylinder for electromagnetically shielding the first cylinder, wherein the first shield is electrically insulated from the first cylinder and the wire.

2. The connector as set forth in claim 1, wherein the plug body is an electrical insulator.

3. The connector as set forth in claim 1, wherein the first shield includes a conductive coating or sheet disposed around the base.

4. The connector as set forth in claim 1, wherein the first shield surrounds the wire for electromagnetically shielding the wire.

5. The connector as set forth in claim 4, wherein the first shield includes a conductive coating or sheet that is (i) disposed on a periphery of the base around the first cylinder, (ii) disposed on a periphery of the neck around the wire and (iii) disposed through the plug body between the neck and the first cylinder.

6. The connector as set forth in claim 1, wherein:

the securing means includes a sleeve assembly having an externally threaded, male coaxial connector on a first end thereof and a sleeve having a mouth which opens toward a second end thereof;

the male coaxial connector has a conductive core that extends therethrough and includes a receiving cylinder adjacent the first end of the sleeve assembly and a wire projection that extends into a cavity defined by the sleeve;

the external threads and the sleeve are in electrical contact and are electrically isolated from the core of the male coaxial connector;

the sleeve is configured to receive the base of the plug body when the wire projection of the male coaxial connector is received in the first cylinder; and the sleeve is in electrical contact with the first shield when the base of the plug body is received in the sleeve.

7. The connector as set forth in claim 1, wherein:

the securing means includes a plurality of enclosure sections configured to mate and form an enclosure that receives the base of the plug body therein with the neck extending therefrom; and when the core of the coaxial cable is received in the first cylinder and the enclosure sections are mated, the enclosure section clamp the coaxial cable therebetween.

8. The connector as set forth in claim 7, wherein the first shield includes:

a first conductive sheet supported by the plug body surrounding the first cylinder and the wire;

a second conductive sheet supported by each enclosure section, the second conductive sheet of each enclosure section electrically contacting a conductive shield of the coaxial cable when the core of the coaxial cable is received in the first cylinder and the enclosure sections are mated; and an electrically conductive spring biased in electrical contact between the second conductive sheet of each enclosure section and the first conductive sheet.

9. The connector as set forth in claim 7, wherein, the enclosure and the plug body are rotatable around an axis coaxial with the core of the coaxial cable.

10. The connector as set forth in claim 1, wherein the first shield electrically contacts a conductive shield of the coaxial cable when the securing means secures the coaxial cable and the plug body together.

11. The connector as set forth in claim 1, further including:

a housing body including a receiving aperture formed therein for receiving the neck of the plug body;

a conductor received in the housing body and configured to electrically contact the wire when the neck of the plug body is received in the receiving aperture; and a second shield surrounding the receiving aperture and the conductor for electromagnetically shielding the receiving aperture and the conductor, wherein the second shield is electrically insulated from the conductor.

12. The connector as set forth in claim 11, wherein:

the conductor extends from the receiving aperture through the housing body, the conductor having an exposed end which extends outward from the housing body; and the second shield includes a shield wire having an exposed end which extends outward from the housing body.

13. The connector as set forth in claim 11, wherein:

the wire has an exposed end which extends outward from the neck of the plug body; and the conductor includes a second, conductive cylinder configured to receive the exposed end of the wire when the neck is received in the receiving aperture.

14. The connector as set forth in claim 13, wherein:

the second cylinder extends through the housing body between the receiving aperture and an exterior of the housing body for receiving the core of another coaxial cable therein from the exterior of the housing body; and the housing body includes a securing means for securing the other coaxial cable thereto when the core of the other coaxial cable is received in the second cylinder.

15. The connector as set forth in claim 14, wherein the first shield electrically contacts the second shield when the neck of the plug body is received in the receiving aperture of the housing body.

16. The connector as set forth in claim 15, wherein the second shield electrically contacts a conductive shield of the other coaxial cable when the core thereof is received in the second cylinder.

17. The connector as set forth in claim 11, further including:

illumination means disposed in the housing body; and circuit means connected to the illumination means, the conductor and the second shield, wherein the circuit means connects the illumination means to a source of electrical power in response to detecting between the conductor and the second shield a voltage greater than a predetermined trigger voltage.

18. The connector of claim 17, wherein the illumination means includes at least one LED device.

19. The connector as set forth in claim 11, further including a filter circuit disposed in the housing body and electrically connected between the conductor and the second shield for filtering electrical signals propagating on the conductor.

20. A connector for a coaxial cable, the connector comprising:

a plug body having a first conductor extending therethrough which is exposed adjacent one end of the plug body and a first shield surrounding the first conductor and electrically isolated therefrom for electromagnetically shielding the first conductor, the plug body configured to mate with the coaxial cable such that a core and a shield of the coaxial cable are electrically connected to the respective first conductor and first shield;

a housing body including a receiving aperture formed therein for receiving the plug, a second conductor received in the housing body for electrically contacting the first conductor when the plug is received in the receiving aperture and a second shield surrounding the receiving aperture and the second conductor and electrically isolated from the second conductor for electromagnetically shielding the receiving aperture and the second conductor, wherein the first shield and the second shield are electrically connected when the plug is received in the receiving aperture.

21. The connector as set forth in claim 20, wherein:

the plug body is an RJ type male plug having the first conductor exposed on a periphery thereof that is configured to be received in the receiving aperture; and the housing is an RJ type female housing having the second conductor positioned to contact the first conductor when the plug body is received in the receiving aperture.

22. The connector as set forth in claim 21, wherein:

the first conductor includes a plurality of contacts exposed on the periphery of the plug body; and the second conductor includes a plurality of contacts positioned to contact the plurality of contacts exposed on the periphery of the plug body when the plug body is received in the receiving aperture.

23. The connector as set forth in claim 21, wherein the second conductor and the second shield each include an exposed wire that extends away from the housing body for electrical connection to another fixture.

24. The connector as set forth in claim 20, wherein:

the first conductor has an exposed end which extends outward from the plug body; and the second conductor includes a cylinder configured to receive the exposed end of the first conductor when the plug body is received in the receiving aperture.

25. The connector as set forth in claim 20, further including an enclosure enclosing an end of the plug body opposite the exposed end of the first conductor, wherein:

the enclosure secures the coaxial cable and the plug body together; and the coaxial cable and the enclosure are rotatable with respect to the plug body around an axis of the core of the coaxial cable.

26. The connector as set forth in claim 20, further including:

illumination means disposed in the housing body; and circuit means electrically connected to the illumination means, the second conductor and the second shield, wherein the circuit mean connects the illumination means to a source of electrical power in response to detecting between the second conductor and the second shield a voltage greater than a predetermined voltage.

27. The connector of claim 26, wherein the illumination means includes at least one LED device.

28. The connector as set forth in claim 20, further including a filter circuit disposed in the housing body and electrically connected between the second conductor and the second shield for filtering electrical signals propagating on the second conductor.

29. A connector comprising:

an RJ type female housing configured to mate with a first coaxial cable having a central conductor in spaced coaxial relation with a conductive sheath, the RJ type housing having a second conductor received therein and a second shield in spaced relation around the second conductor, the second conductor and the second shield electrically contacting the respective central conductor and conductive sheath of the first coaxial cable when the RJ type housing and the first coaxial cable are mated, and an RJ type male plug configured to mate with a second coaxial cable having a central conductor in spaced coaxial relation with a conductive sheath, the RJ type plug including a first conductor which extends between an interior and an exterior of the RJ type plug and a first shield in spaced relation around the first conductor, the first conductor and the first shield electrically contacting the respective central conductor and conductive sheath of the second coaxial cable when the RJ type plug and the second coaxial cable are mated, wherein the RJ type housing and the RJ type plug are configured to mate with the first conductor and the first shield contacting the second conductor and the second shield, respectively.

30. The connector of claim 29 wherein the RJ type female housing includes attachment means associated with the housing for mounting the connector along a vertical surface.

* * * * *

UNITED STATES PATENT AND TRADEMARK OFFICE

CERTIFICATE OF CORRECTION

PATENT NO. : 6,290,538 B1
DATED : September 18, 2001
INVENTOR(S) : Alan L. Pocrass It is certified that error appears in the above-identified patent and that said Letters Patent is hereby corrected as shown below:

Title page, Item [54] and Column 1, line 2,
Delete "WITH VISUAL INDICATOR".

Column 7,
Line 67, (last line), "RJ tpe" should read -- RJ type --.

Column 8,
Line 58, "sections 221" should read -- sections 22' --.
Line 60, "sections 221" should read -- sections 22' --.

Column 9,
Line 55, "trunated" should read -- truncated --.

Column 10,
Line 43, "RJ tppe" should read -- RJ type --.

Signed and Sealed this

Sixth Day of August, 2002

*Attest:*

*Attesting Officer*

JAMES E. ROGAN
*Director of the United States Patent and Trademark Office*